US006212735B1

(12) United States Patent
Daoud

(10) Patent No.: US 6,212,735 B1
(45) Date of Patent: Apr. 10, 2001

(54) MECHANISM FOR AUTOMATIC CLOSING OF BOX COVER AND GUILLOTINE PROTECTION

(75) Inventor: Bassel Hage Daoud, Parsippany, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/422,005

(22) Filed: Oct. 20, 1999

(51) Int. Cl.[7] ..... E05D 11/06
(52) U.S. Cl. ..... 16/250; 16/74; 49/383
(58) Field of Search ..... 16/250, 225, 223, 16/277, 280, 281, 74; 49/383

(56) References Cited

U.S. PATENT DOCUMENTS

| | | | | |
|---|---|---|---|---|
| 1,444,398 | * | 2/1923 | Shepherd | 49/383 |
| 1,524,765 | * | 2/1925 | Van Arnhem | 16/74 |
| 1,626,844 | * | 5/1927 | Kuhn | 49/383 |
| 2,504,635 | * | 4/1950 | Bradley | 49/383 |
| 2,641,792 | * | 6/1953 | Peeler | 16/250 |
| 5,001,862 | * | 3/1991 | Albenda | 16/251 |
| 5,220,708 | * | 6/1993 | Lucas et al. | 16/250 |
| 5,419,084 | * | 5/1995 | Sankey et al. | 49/383 |
| 5,669,106 | | 9/1997 | Daoud . | |

FOREIGN PATENT DOCUMENTS

| | | | | |
|---|---|---|---|---|
| 3716654 | * | 12/1988 | (DE) | 49/383 |
| 0273087 | * | 11/1989 | (DE) | 16/74 |
| 2565622 | * | 12/1985 | (FR) | 16/250 |

* cited by examiner

*Primary Examiner*—Chuck Y. Mah
(74) *Attorney, Agent, or Firm*—Schnader Harrison Segal & Lewis LLP

(57) ABSTRACT

An apparatus for use with hinged members is provided. The apparatus is an elastomeric member affixed to hinged members on opposing sides of a longitudinal axis of rotation. The elastomeric member is affixed in a stretched state to facilitate the resilient return of the hinged members to a closed position. The elastomeric member occupies substantially the entire length of the hinge area. The elastomeric member bridges the hinge area between the two hinged members. Thus, the hinge area is protected against the entrance of stray wires or materials.

14 Claims, 3 Drawing Sheets

MECHANISM FOR AUTOMATIC CLOSING OF BOX COVER AND GUILLOTINE PROTECTION

BACKGROUND OF THE INVENTION

Field of the Invention

This invention relates to an apparatus for closing hinged objects and preventing foreign materials from entering the hinge area. More specifically, the invention relates to an elastic member for maintaining hinged members in a closed arrangement while deterring stray matter from entering the hinge area.

Description of the Related Art

Any number of hinged devices can be found in use today. Some hinged devices are biased to an open position, while others are biased to a closed position. Still others are not biased to either position. Hinged members include doors and box lids and may be horizontal, vertical or somewhere in between. Regardless of the orientation, an immediate advantage of biasing a box lid in the closed position is to keep the desirable items in and undesirables out. This is especially apparent when the box houses electrical components and is exposed to the elements.

Hinges and devices for closing hinged members are well known in a wide variety of products. One need look no further than to an automatically closing door to see one variety of closing devices. All manner of springs and motor driven devices can be found to close or maintain closure of hinged members such as doors and lids.

Because of the nature of the components housed therein, electrical boxes often include a hinged cover attached to a base. The cover protects the delicate and even dangerous wires and electrical components housed within the box from tampering and nature's elements. Typically, the cover is closed with a manually activated latch to keep the cover closed. The latched cover is important to shield against wind and rain in outdoor applications. Occasionally, the latch is broken or inadvertently left in an unlatched position. The unlatched cover is subject to the forces of nature, especially wind which can open the cover and expose its contents to rain, wind and other elements. A closed box is also less tempting to animals or people that might be drawn to an open box filled with electrical components. It would be beneficial to provide electrical boxes and other hinged devices with a mechanism for closing and maintaining a closed position, when the box is left unattended, even where the latch is not used or fails.

Another problem encountered in boxes housing electrical components involves stray or loose wires. These wires often wander and find their way into the hinge area of the box. In order to close the box, a person has to tuck the wires into a position away from the hinge area with their fingers while closing the box lid. Unfortunately, this method is unreliable and often results in pinched fingers. Repeated attempts are often necessary before the box lid will even close. In some instances, the wires are crimped or otherwise damaged by the closing action of the box lid. In a worst case scenario, the box lid guillotines the wire, severing it completely. This is not only inconvenient, but potentially hazardous.

Despite advances in wire control, electrical systems are plagued by stray or loose wires. In some instances, a certain amount of slack is needed in the wire due to its position in a certain application. This is often the case where a wire runs from, for example, the base portion of an electrical box over the hinge area and up to the cover area of the box. To allow the hinged cover to open, a certain amount of slack is necessary. This situation subjects wires to potential damage if they wander into the hinge area. Often, wires are damaged or sliced completely when they are caught between two closing hinged members. This scenario is also seen in other hinged devices, such as jewelry boxes where an errant necklace or bracelet may be ruined when the chain is accidentally caught between the lid and the base. It would, therefore, be beneficial to have an apparatus which would hinder the entrance of foreign material into the hinge area.

Some hinges are specifically designed to maintain a lid or other hinged member in an open position. One such hinge is disclosed by U.S. Pat. No. 5,669,106. The hinge is designed to maintain a cover portion at a defined position. This hinge mechanism has been employed in a layered box design for housing electrical components. The hinge allows unhindered access to the box interior. Once the cover is displaced to a certain angle, it is held in place by the shape of the hinge parts. Similarly, once the displaced angle is reached in the opposite direction, the cover is free to return to its closed position. This type of hinge is not immune to the type of problems associated with other hinged members.

SUMMARY OF THE INVENTION

An apparatus for use with hinged members is provided. The apparatus is an elastomeric member affixed to hinged members on opposing sides of a longitudinal axis of rotation. The elastomeric member is affixed in a stretched state to facilitate the resilient return of the hinged members to a closed position. The elastomeric member occupies substantially the entire length of the hinge area. The elastomeric member bridges the hinge area between the two hinged members. Thus, the hinge area is protected against the entrance of stray wires or materials.

DETAILED DESCRIPTION OF THE INVENTION

Figure 1:
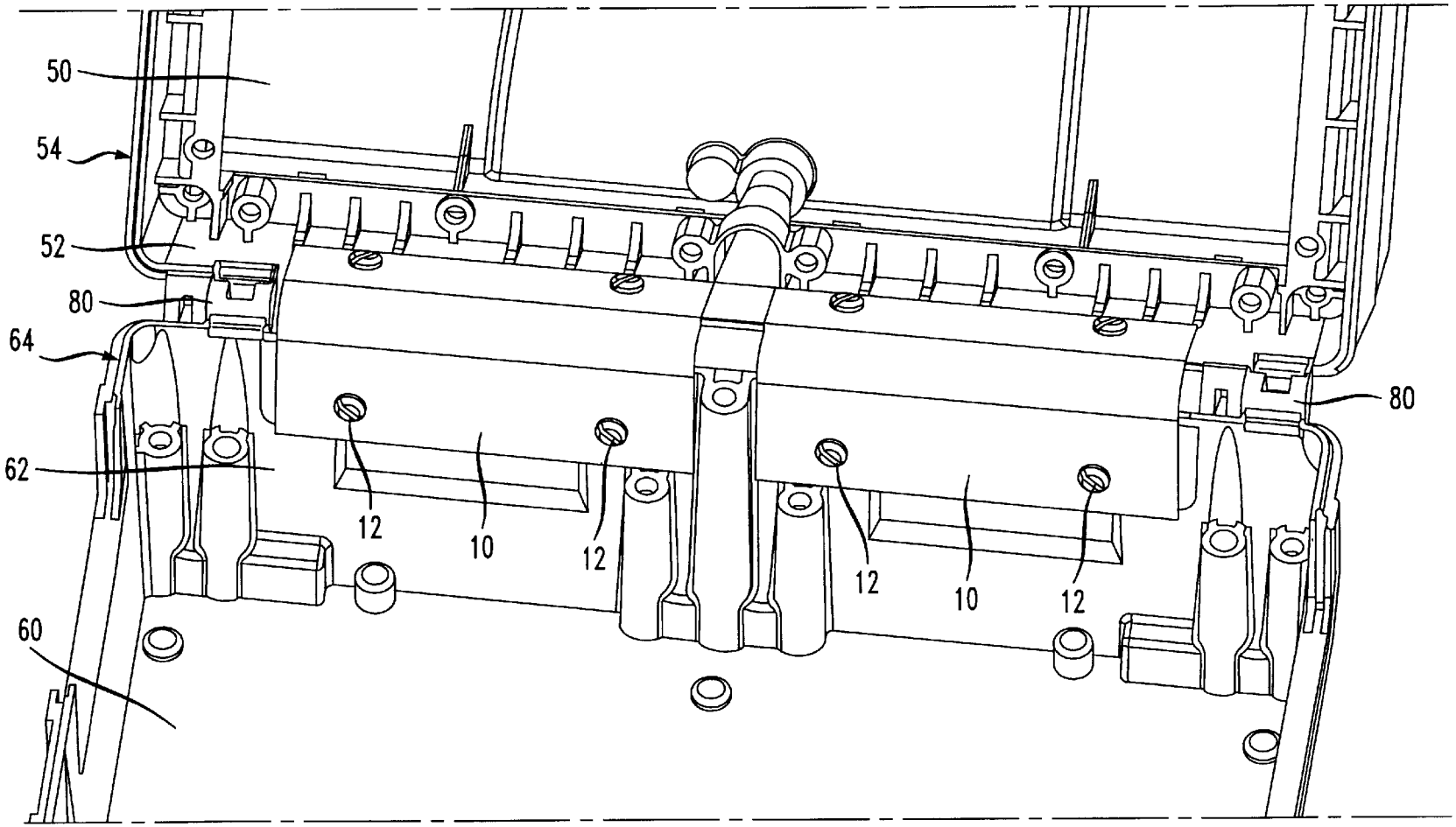
FIG. 1 is an environmental perspective view of the invention installed in an open electrical box.

The invention is depicted in the Figures where reference numerals designate like elements throughout.

As seen in FIG. 1, the invention is for use with hinged members. The hinged members will often be part of a box structure, including a cover 50 and a base 60. Typical of such an arrangement is the electrical box depicted in FIG. 1. Although the invention is disclosed and described with reference to an electrical box, the invention is not limited to that application.

Figure 2:
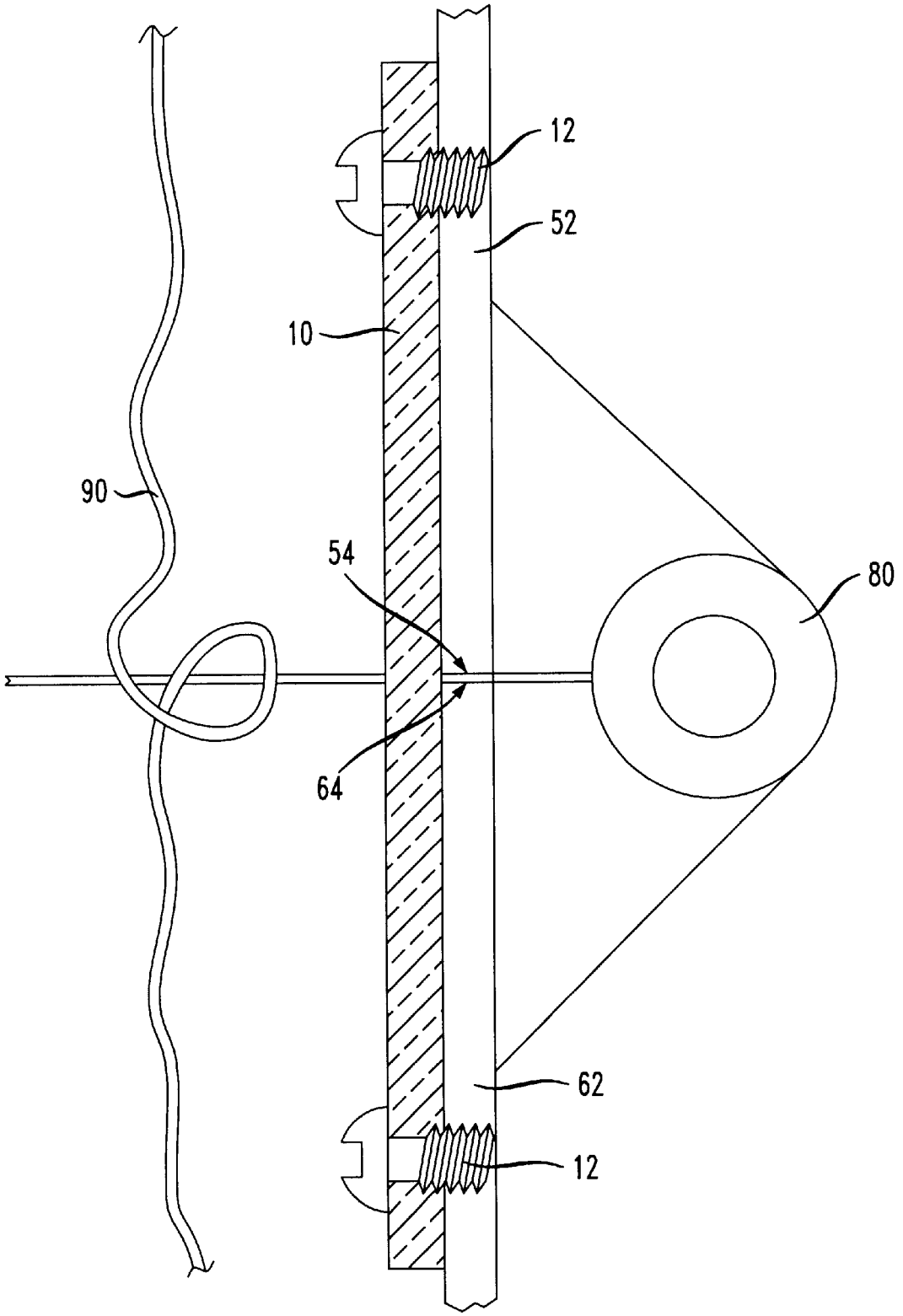
FIG. 2 is a partial cross sectional view of the invention with a hinge in a closed position.

Generally, the electrical box has a base 60 and a cover 50. The base 60 has a generally planar hinge wall portion 62 terminated by a straight edge portion 64. Similarly, the cover 50 has a generally planar hinge wall portion 52 terminated by a straight edge portion 54. The hinge wall portions 52, 62 are generally co-planar, with the base straight edge portion 64 and the cover straight edge portion 54 being closely adjacent to each other when the cover 50 is in a closed position relative to the base 60. This area is referred to as the hinge area. Stray wires 90, as shown in FIG. 2, often get caught in this area. A hinge mechanism 80 is secured to the base hinge wall portion 62 and the cover hinge wall portion 52 defining a longitudinal axis of rotation therebetween.

As shown in FIG. 1, according to the invention, an elastic member 10 is attached to the hinge wall portion 52 of the cover 50 and the hinge wall portion 62 of the base 60. It is important that the elastomeric member 10 be installed in a stretched position, even when the cover 50 is closed. This feature facilitates the closing of the box cover 50 when left unattended. The resiliency of the elastomeric member 10 helps maintain the cover 50 in a closed position against elements such as wind and rain. FIG. 1 shows two such elastomeric members 10, occupying substantially the entire length along the longitudinal axis of rotation.

The length and width of the elastomeric member 10 will be determined by the size and shape of the hinged members. The material and its thickness, however, will determine the elasticity of the member. The elastomeric material may be any material having suitable elastic properties. Currently preferred is silicone rubber, although neoprene rubber may also be used.

Since the choice of materials determines the elastic qualities, it is possible to select a desired resiliency. The resiliency of the elastic member should not be great enough to overcome the special retaining features built into certain hinges such as that disclosed in U.S. Pat. No. 5,669,106 as discussed above, which are specifically designed to hold hinged members in an open position until a certain force is applied or displacement angle achieved. More simply stated, the elasticity of the elastomeric member of the invention is specifically chosen not to exceed the amount of force necessary to move such a hinge mechanism from a locked open position. An upper torque range of about 12 inch/pound is preferred. This limit is selected because it is not enough to override the retention mechanism of the special hinge. The cover 50 must be moved from a locked, opened position through manual adjustment. With properly selected elastic properties, the benefits of both mechanisms will be seen.

Figure 3:
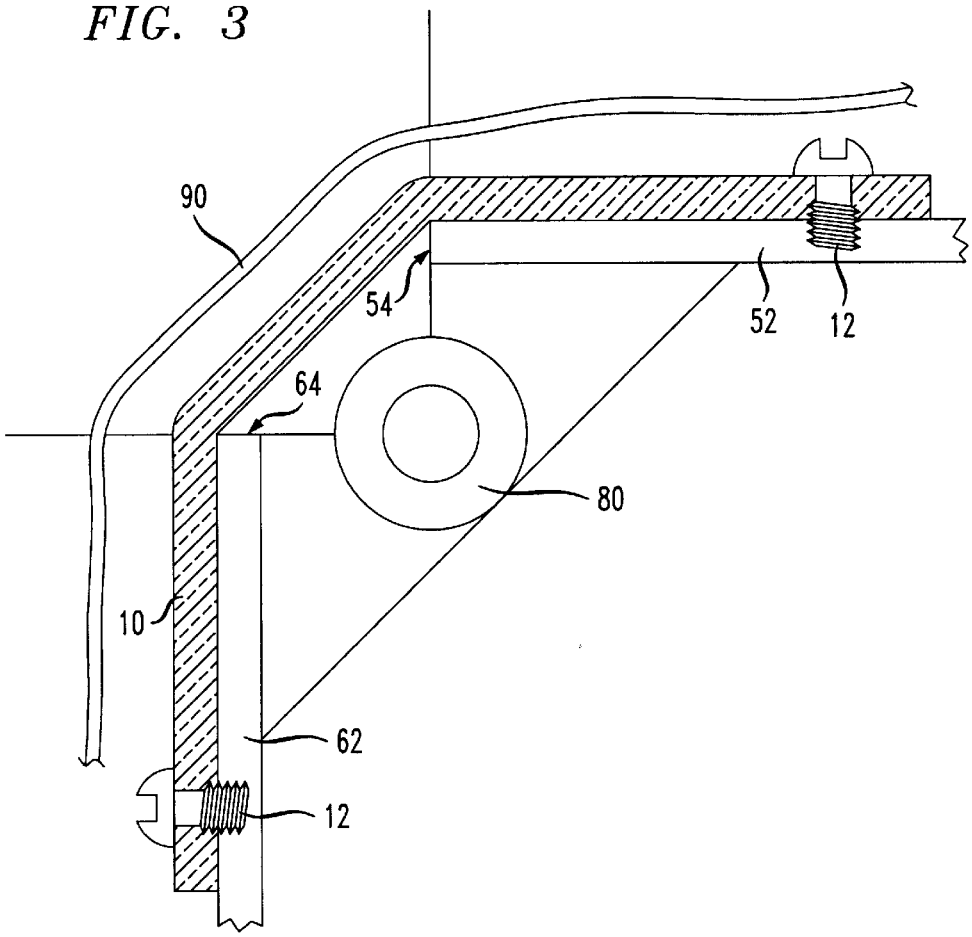
FIG. 3 is a partial cross-sectional view of the invention with an open hinge.

The elastomeric member 10 may be attached to the hinged members by any appropriate means. FIGS. 1–3 show the elastomeric member 10 attached by a plurality of screws 12. The screws may be affixed directly through the elastomeric member 10, cutting a hole as they are inserted, or through a preformed aperture designed to receive the screw.

Figure 4:
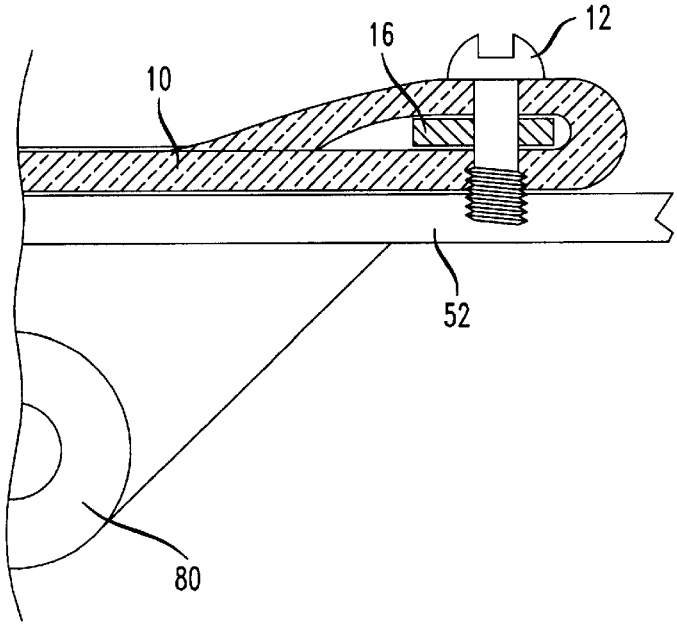
FIG. 4 is a partial cross-section showing an alternative attachment method according to the invention.

FIG. 4 shows an alternative design. In this embodiment, the edges of the elastomeric member associated with the hinge wall portions 52, 62 form a loop which defines a cavity. A rigid plate 16, preferably metallic or hard plastic, is inserted in the cavity along the length of the elastomeric member 10. Again, screws 12 or other fastening devices are used to secure the elastomeric member 10 to the hinge wall portions 52, 62. Apertures may be provided for facilitating the application of the fasteners. The rigid plate 16 provides the added advantage of more uniform and secure attachment of the elastomeric member 10 and provides a standard edge from which the elastomeric member 10 can stretch. This helps prevent uneven stretching and wear, especially around the fasteners 12.

The invention provides a means for closing hinged members, and maintaining that closed relationship against inadvertent opening forces, while simultaneously inhibiting the advancement of loose or stray wires into the hinge area. The apparatus therefore provides the safety function of maintaining an electrical box in a closed arrangement even when it is unlatched. Furthermore, the problem of damaged or guillotined wires is substantially avoided.

What is claimed is:

1. An apparatus for use with hinged members comprising:

an elastomeric member affixed to each hinged member at opposing positions opposite a longitudinal axis of rotation extending between said hinged members such that said elastomeric member maintains said hinged members in a closed position until a predetermined amount of opening force is applied, and elastically returns the hinged members to a closed position when said force is removed, wherein said elastomeric member extends substantially across an area between each of said hinged members for substantially blocking the area to foreign materials.

2. The apparatus of claim 1, wherein said elastomeric member comprises silicone rubber.

3. The apparatus of claim 2, wherein the elastomeric member is about 0.1 inch thick and has an elasticity of about 10 pounds per inch of displacement.

4. The apparatus of claim 1, wherein said elastomeric member comprises neoprene rubber.

5. The apparatus of claim 1, wherein said elastomeric member is secured in a stretched state, via fastening means passing therethrough and into each respective hinged member.

6. The apparatus of claim 1, further comprising a rigid support plate positioned opposite said elastomeric member and parallel to said longitudinal axis of rotation, through which fasteners are secured to each respective hinged member to secure said elastomeric member.

7. The apparatus of claim 1 for use in a box housing electrical wires and components, wherein said elastomeric member inhibits wires from entering the hinge area and limits guillotine of stray wires.

8. An apparatus for use with hinged members each having a hinge wall portion with a substantially straight edge portion, wherein the hinged members pivot along a longitudinal axis parallel to the straight edge portions, and such that when the hinged members are in a closed position, the straight edge portions are substantially adjacent to one another, said apparatus comprising:

(a) a generally rectangular elastomeric member having a predetermined elasticity;

(b) wherein said elastomeric member is secured to the hinge wall portion of each hinged member to resistively hold the hinged members in a closed relationship until application of a pre-determined amount of opening force and to elastically return the hinged members to the closed position when the force is removed; and (c) wherein said elastomeric member is oriented and secured to extend over the straight edge portion of each hinged member along substantially the length of the longitudinal axis, such that loose matter is hindered from entering an area between the hinged members.

9. The apparatus of claim 8, wherein said elastomeric member comprises silicone rubber.

10. The apparatus of claim 8, wherein the elastomeric member is about 0.1 inch thick and has an elasticity of about 10 pounds per inch of displacement.

11. The apparatus of claim 8, wherein said elastomeric member comprises neoprene rubber.

12. The apparatus of claim 8, wherein said elastomeric member is secured in a stretched state, via fastening means passing therethrough and into each respective hinge wall portion.

13. The apparatus of claim 8, further comprising a rigid support plate positioned opposite said elastomeric member and parallel to said longitudinal axis of rotation, through which fasteners are secured to respective hinge wall portions to secure said elastomeric member.

14. The apparatus of claim 8 for use in a box housing electrical wires and components, wherein said elastomeric member inhibits wires from entering the hinge area and limits guillotine of stray wires.

* * * * *